US007075457B1

(12) United States Patent
Chidester et al.

(10) Patent No.: US 7,075,457 B1
(45) Date of Patent: Jul. 11, 2006

(54) ENERGY INDEX FOR AIRCRAFT MANEUVERS

(75) Inventors: Thomas R. Chidester, Mountain View, CA (US); Robert E. Lynch, San Carlos, CA (US); Robert E. Lawrence, Los Altos, CA (US); Brett G. Amidan, Kennewick, WA (US); Thomas A. Ferryman, Richland, WA (US); Douglas A. Drew, Peachtree City, GA (US); Robert J. Ainsworth, Dunwoody, GA (US); Gary L. Prothero, Corvallis, OR (US); Timothy P. Romanowski, Corvallis, OR (US); Laurent Bloch, Dallas, TX (US); William L. Craine, Vancouver, WA (US); Vincent J. Zaccardi, Eastchester, NY (US)

(73) Assignee: The United States of America as represented by the Administrator of the National Aeronautics and Space Administration (NASA), Washington, DC (US)

( * ) Notice: Subject to any disclaimer, the term of this patent is extended or adjusted under 35 U.S.C. 154(b) by 23 days.

(21) Appl. No.: 10/956,523

(22) Filed: Sep. 22, 2004

(51) Int. Cl.
*G08B 23/00* (2006.01)

(52) U.S. Cl. ..... 340/963; 340/945; 340/946; 340/969; 340/970

(58) Field of Classification Search ..... 340/945, 340/946, 963, 967, 968, 969, 970; 701/3, 701/121; 244/181, 191
See application file for complete search history.

(56) References Cited

U.S. PATENT DOCUMENTS 4,667,196 A * 5/1987 Kaul ..... 340/954
5,053,767 A * 10/1991 Zweifel et al. ..... 340/968
5,079,711 A * 1/1992 Lambregts et al. ..... 701/3

* cited by examiner

*Primary Examiner*—Van T. Trieu
(74) *Attorney, Agent, or Firm*—John F. Schipper; Robert M. Padilla

(57) ABSTRACT

Method and system for analyzing, separately or in combination, kinetic energy and potential energy and/or their time derivatives, measured or estimated or computed, for an aircraft in approach phase or in takeoff phase, to determine if the aircraft is or will be put in an anomalous configuration in order to join a stable approach path or takeoff path. A reference value of kinetic energy and/or potential energy (or time derivatives thereof) is provided, and a comparison index for the estimated energy and reference energy is computed and compared with a normal range of index values for a corresponding aircraft maneuver. If the computed energy index lies outside the normal index range, this phase of the aircraft is identified as anomalous, non-normal or potentially unstable.

19 Claims, 3 Drawing Sheets

ENERGY INDEX FOR AIRCRAFT MANEUVERS

ORIGIN OF THE INVENTION

This invention was made, in part, by one or more employees of the U.S. government. The U.S. government has the right to make, use and/or sell the invention described herein without payment of compensation therefor, including but not limited to payment of royalties.

FIELD OF THE INVENTION

This invention relates to monitoring and analysis of kinetic energy and potential energy of an ascending or descending aircraft.

BACKGROUND OF THE INVENTION

An aircraft that is ascending following takeoff or descending on approach will have measurable kinetic energy and potential energy components, and these components will change with time in measurable manners. Desirable energy states for both takeoff and landing can be determined from aircraft manufacturer guidance for these phases of flight. For example, where the approach occurs at an airport with an operable and reliable instrument landing system (ILS), the ILS system may provide data recorded on the aircraft to serve as a standard for comparing observed kinetic and potential energy components for an aircraft near the ground, below 2500 feet altitude and for an assumed straight path to a touchdown site. If the airport has no operable and reliable ILS, or if the aircraft is not near the ground, another mechanism for providing a standard for measurements or estimates is needed. On takeoff, where no electronic guidance comparable to the glideslope is available, the aircraft climb profile can be compared to manufacturer guidance or to observed performance for recorded aircraft departures from the particular airport.

The airline industry has become concerned with the problem of unstable aircraft approaches, because approach and landing accidents often begin as unstable approaches. An "unstable approach" is often defined as an approach where below a threshold altitude (1000 feet for IFR and 500 feet for VFR), the aircraft is not established on a proper glide path and with a proper air speed, with a stable descent rate and engine power setting, and with a proper landing configuration (landing gear and flaps extended). Airlines have developed approach procedures that call for abandonment of an approach that is determined to be unstable.

Development and testing of methods for detecting atypical flights by N.A.S.A. has revealed that high energy during an arrival phase (below 10,000 feet but before beginning an approach) is the most common reason for a flight to be identified as atypical or out of a statistically normal range. An atypical high energy arrival phase often corresponds to aircraft kinetic energy and/or potential energy that requires dissipation of 10–30 percent more energy than is required for a normal arrival phase. A normal arrival phase may correspond to about a 3° slope glide path and decelerating to an airspeed of about 250 knots during descent through 10,000 feet altitude to a standard reference speed around 2,500 feet altitude, when beginning an approach.

More than half of the high energy arrivals identified by atypicality analysis were brought under control within stabilized approach criteria; some of the remainder of the high energy arrivals were abandoned. In contrast, where these findings were used to define and search for a high-energy arrival exceedance, about three times as many excedances were detected; and the resulting unstable approaches were found to occur more frequently than the recoveries.

It may be possible to identify a first class of high energy arrivals where recovery and subsequent stabilization is possible and relatively easy, and a second class of high energy arrivals in which recovery and subsequent stabilization is likely to be difficult or impossible. However, the present procedures for determining presence of a normal approach include an electronic glide slope that extends linearly from the end of a target runway to the aircraft, whereas a typical (normal) aircraft approach path is curved and follows the electronic glide slope only from about 1,800 feet above the field to the end of the runway.

A 3-to-1 glide path slope, corresponding to decrease of 1,000 feet in altitude for every 3 nautical miles horizontal travel, is often desirable during an arrival phase. The air speed is 250 knots or less by regulation below 10,000 feet, and the aircraft decelerates to a reference speed before joining the approach path. These parameters are directly available but are unlikely to prove to be the only relevant parameters in determining whether a flight arrival phase is normal or other than normal.

What is needed is a system that (1) provides estimates of kinetic energy and potential energy components, and rates of change thereof, of an ascending or descending aircraft at any altitude, (2) provides reference values of kinetic energy and potential energy components, and rates of change thereof, of the aircraft; (3) provides one or more comparison indices for the estimated and reference values; and (4) advises an aircraft operator if the measured comparison indices are too far from the corresponding index values for a normal flight approach.

SUMMARY OF THE INVENTION

These needs are met by the invention, which provides a method and a system for monitoring an ascending or descending aircraft to determine if the kinetic and/or potential energy of the aircraft is within, or is outside of, a range for a normal flight. This invention can be used in post-flight review of flight data and/or as part of a flight operations quality assurance program, and can be implemented in an aircraft flight management computer to alert a pilot in real time to presence of an anomalous energy state.

In one embodiment, the method includes the steps of:

(i) providing an estimate or measurement of a value (referred to as an "estimated value") of an energy component, $E(t_n)=d1\cdot KE(t_n)+d2\cdot PE(t_n)$ of an aircraft during an ascent phase or descent phase of a flight, at each of a first sequence of times ($n=1 \ldots, N$; $N \geqq 2$), where d1 and d2 are selected real numbers, not both 0, such as (d1,d2)=(1,0) or (1,1) or (0,1) or (d,1−d) with $0<d<1$.

(ii) providing a reference value of the energy component $E(t'_n;ref)$ and/or reference values of the separate kinetic and potential energy components, $KE(t'_n;ref)$ and $PE(t'_n;ref)$ at a time, $t=t'_n$, determined with reference to the time $t_n$ ($n=1, \ldots N$);

(iii) computing an index of comparison value $C1\{E(t_n), E(t'_n;ref)\}$ of the estimated and reference energy components for at least one time numbered n; and (iv) when the comparison index value C1 lies outside a selected range, interpreting this condition as indicating that the estimated energy component is anomalous.

A comparison index may be based on one or more point values of the estimated and reference values of the energy component; or may be based on a weighted average over time of the estimated and reference values of the energy components. The comparison index may be chosen from a group of such indices that includes: (1) a first ratio $E(t_n)/E(t'_n;ref)\}$; (2) a second ratio $E(t'_n;ref)/E(t_n)$; (3) a difference $E(t_n)-E(t'_n;ref)\}$; (4) an absolute difference $|E(t_n)-E(t'_n;ref)|$; (5) a normalized difference $\{E(t_n)-E(t'_n;ref)\}/\{a\cdot E(t_n)+(1-a)\cdot E(t'_n;ref)\}$, where a is a selected value in a range $0 \leqq a \leqq 1$; and (6) a weighted average of the differences $KE(t_n)-KE(t'_n;ref)$ and/or $PE(t_n)-PE(t'_n;ref)$. An analogous procedure can be applied to time rates of change of the kinetic and potential energy components.

One energy index is a ratio of actual aircraft energy divided by ideal aircraft total energy during an arrival phase. If this ratio lies near a boundary but outside a "normal" range for the energy index (e.g., between about 0.90 and 1.10), this arrival phase may be considered non-normal, and appropriate remedial actions may be taken to recover to a stabilized approach. If this ratio is below a first threshold (e.g., below 0.85) or above a second threshold (e.g., above 1.20) for an arrival phase, the aircraft is unlikely to be able to recover, and the aircraft is better advised to abandon the approach, to execute a go-around, and to re-enter a new arrival phase.

DESCRIPTION OF BEST MODES OF THE INVENTION

Figure 1A:
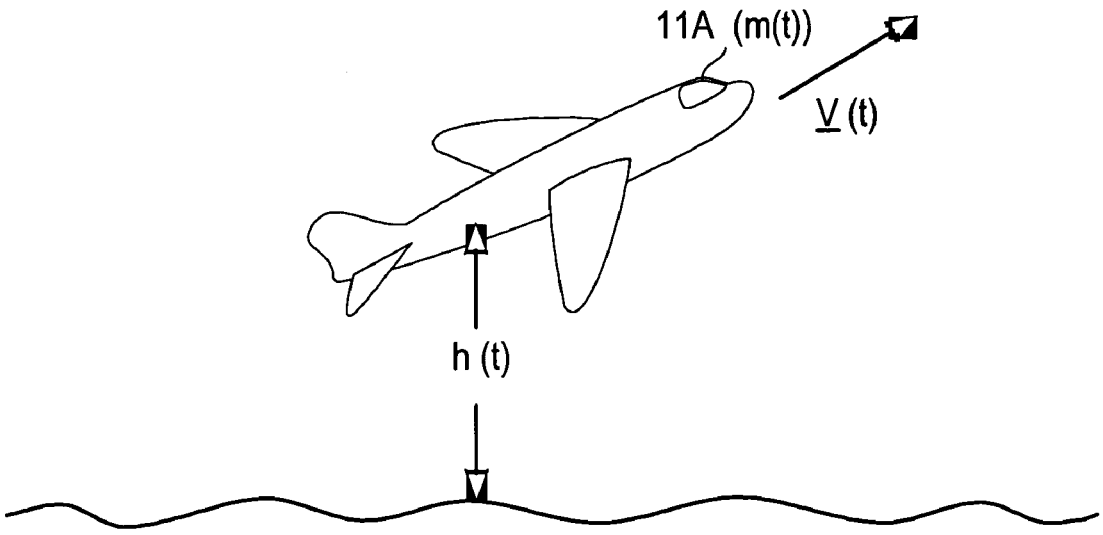
FIGS. 1A and 1B illustrate environments in which the invention can be practiced.
Figure 1B:
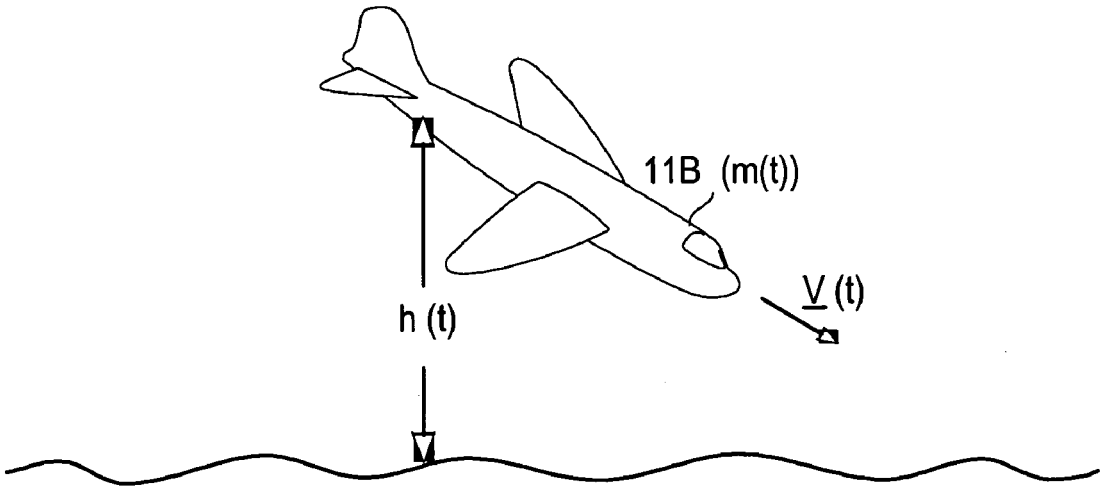

FIGS. 1A and 1B illustrate environments for an ascending aircraft (1A) and for a descending aircraft (1B) where the invention can be practiced. In FIG. 1A, an aircraft 11A is ascending, either after takeoff or in moving from a first flight altitude to a second flight altitude. The aircraft has an associated kinetic energy component $KE(t_n)$, measured or estimated or otherwise provided, at each of a first sequence $\{t_n\}_n$ of two or more time values, and has an associated potential energy component $PE(t_n)$, measured or estimated or otherwise provided, at the first sequence $\{t_n\}_n$ of time values. The aircraft kinetic energy and potential energy components are, respectively, $$KE(t)=m(t)\cdot v(t)^2/2+\omega\cdot I\cdot\omega/2, \tag{1}$$

$$PE(t)=m(t)\cdot g\cdot h(t), \tag{2}$$

where m(t) is the instantaneous mass (taking account of fuel consumption), I(t) is an instantaneous moment of inertia tensor for the aircraft, ω(t) is an aircraft rotation vector, computed with reference to a center of gravity or other selected location determined with reference to the aircraft. (optional), v(t)=dx/dt is the instantaneous aircraft velocity and h(t) is the instantaneous height of aircraft cg above local ground.

Figure 2:
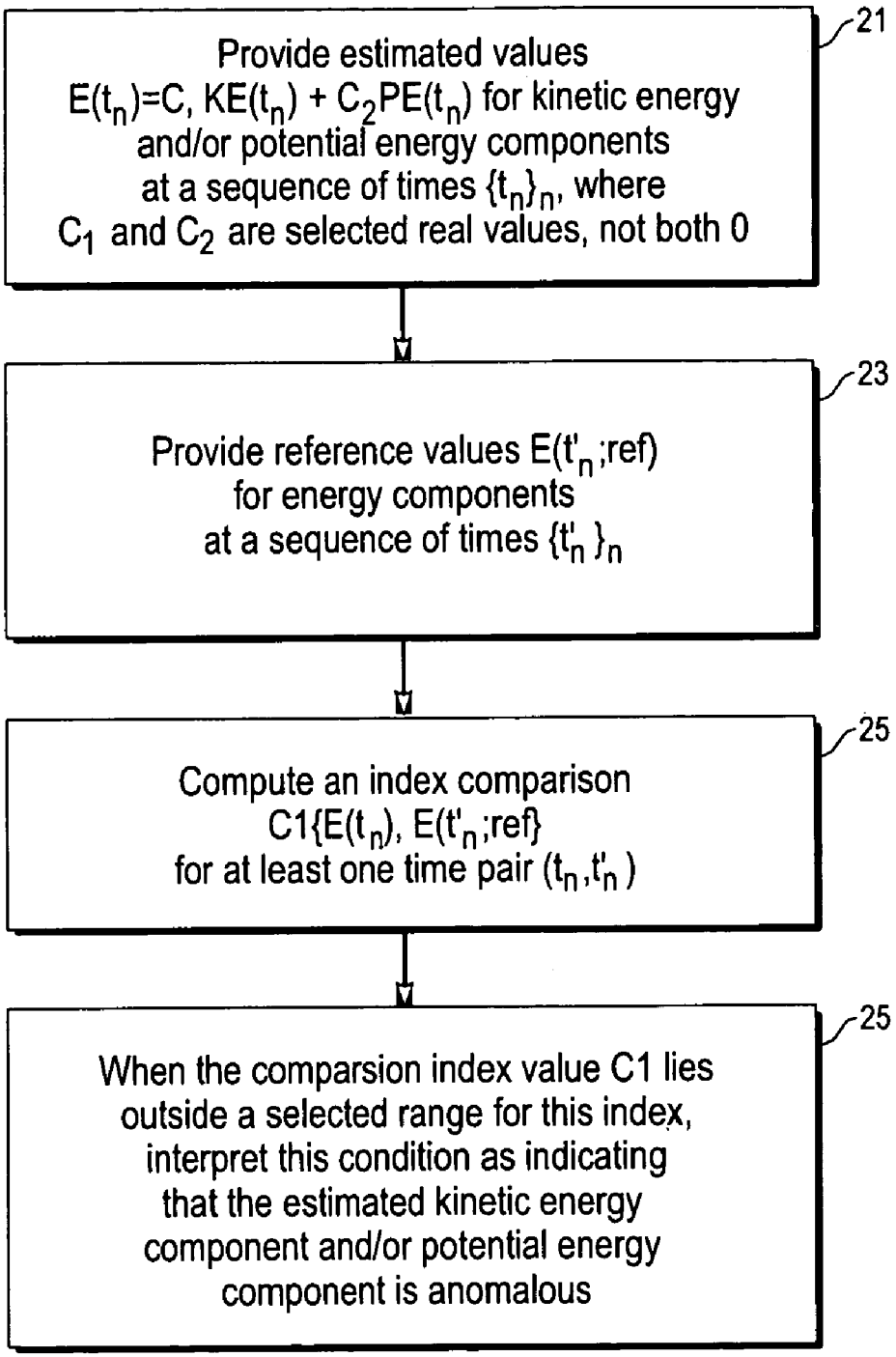
FIGS. 2 and 3 are flow charts of procedures for practicing an embodiment of the invention.

FIG. 2 is a flow chart of a procedure for practicing an embodiment of the invention. In step 21, an aircraft system measures or estimates or otherwise provides a value (referred to as an "estimated value" for convenience herein) $E(t_n)=d1\cdot KE(t_n)+d2\cdot PE(t_n)$ of an energy component of an aircraft during an ascent phase or descent phase of a flight, at each of a first sequence of times (n=1, . . . , N1; $N1 \geqq 2$), where d1 and d2 are selected real values, not both 0. In step 23, the system provides or computes a reference value $E(t'_n;ref)$ of the energy component at a time, $t=t'_n$, determined with reference to the time $t_n$ (n=1, . . . , N1). The time sequence $\{t'_n\}$ may substantially coincide with the sequence $\{t_n\}$, or each time value $t'_n$ may be displaced by a calculable or measurable amount from the corresponding time value $t_n$. In step 25, the system computes an index of comparison value $C1\{E(t_n), E(t'_n;ref)\}$ of the estimated and reference energy components for at least one time value pair $(t_n,t'_n)$. When the comparison index value C1 lies outside a selected range for this index, the system interprets this condition as indicating that the estimated energy component is anomalous or non-normal or may lead to an unstable aircraft maneuver (step 27).

A variety of comparison indices C1 can be used here. Some examples are: (1) a first ratio $E(t_n)/E(t'_n;ref)$; (2) a second ratio $E(t'_n;ref)/E(t_n)$; (3) a difference $E(t_n)-E(t'_n;ref)\}$; (4) an absolute difference $|E(t_n)-E(t'_n;ref)|$; (5) a normalized difference $\{E(t_n)-E(t'_n;ref)\}/\{a\cdot\cdot E(t_n)+(1-a)\cdot E(t'_n;ref)\}$, where a is a selected real value in a range $0 \leqq a \leqq 1$; (6) a weighted average of the differences $KE(t_n)-KE(t'_n;ref)$ and/or $PE(t_n)-PE(t'_n;ref)$, such as $$WA=\sum_{n=1}^{N1} w_n\{|KE(t_n)-KE(t'_n;ref)|^p+|PE(t_n)-PE(t'_n;ref)|^p\}^{1/p}, \tag{3}$$

where p is a selected positive number (e.g., p=1 or 2) and $\{w_n\}_n$ is a sequence of weight values (preferably, but not necessarily, non-negative); and (7) a monotonic function of one or more of the preceding combinations.

The comparison index C1 may use one or a few point values, $E(t_n)$ and $E(t'_n;ref)$, or may use a weighted average of these values, such as the average $$WA1=\sum_{n=1}^{N1} w_n C1\{E(t_n), E(t'_n;ref)\}. \tag{4}$$

The analysis may be extended to consider time rates of change, dE(t)/dt and/or dPE(t)/dt, of the energy components at a sequence of one or more times $\{t_n\}_n$ (n=1 . . . , N2; $N2 \geqq 1$), plus corresponding reference time rates of change, dE(t;ref), at a sequence of times $\{t'_n\}_n$ determined with reference to the time sequence $\{t_n\}_n$. Another comparison index, $C2\{dE(t_n)/dt, dE(t'_n;ref)/dt\}$, which may be the same or different from the comparison index C1, is computed and compared with a second selected range to determine if the aircraft flight is anomalous or non-normal or is within a normal range. Again, the comparison index C2 may use point values or a weighted average of the values dE(t)/dt and/or dE(t;ref)/dt.

Figure 3:
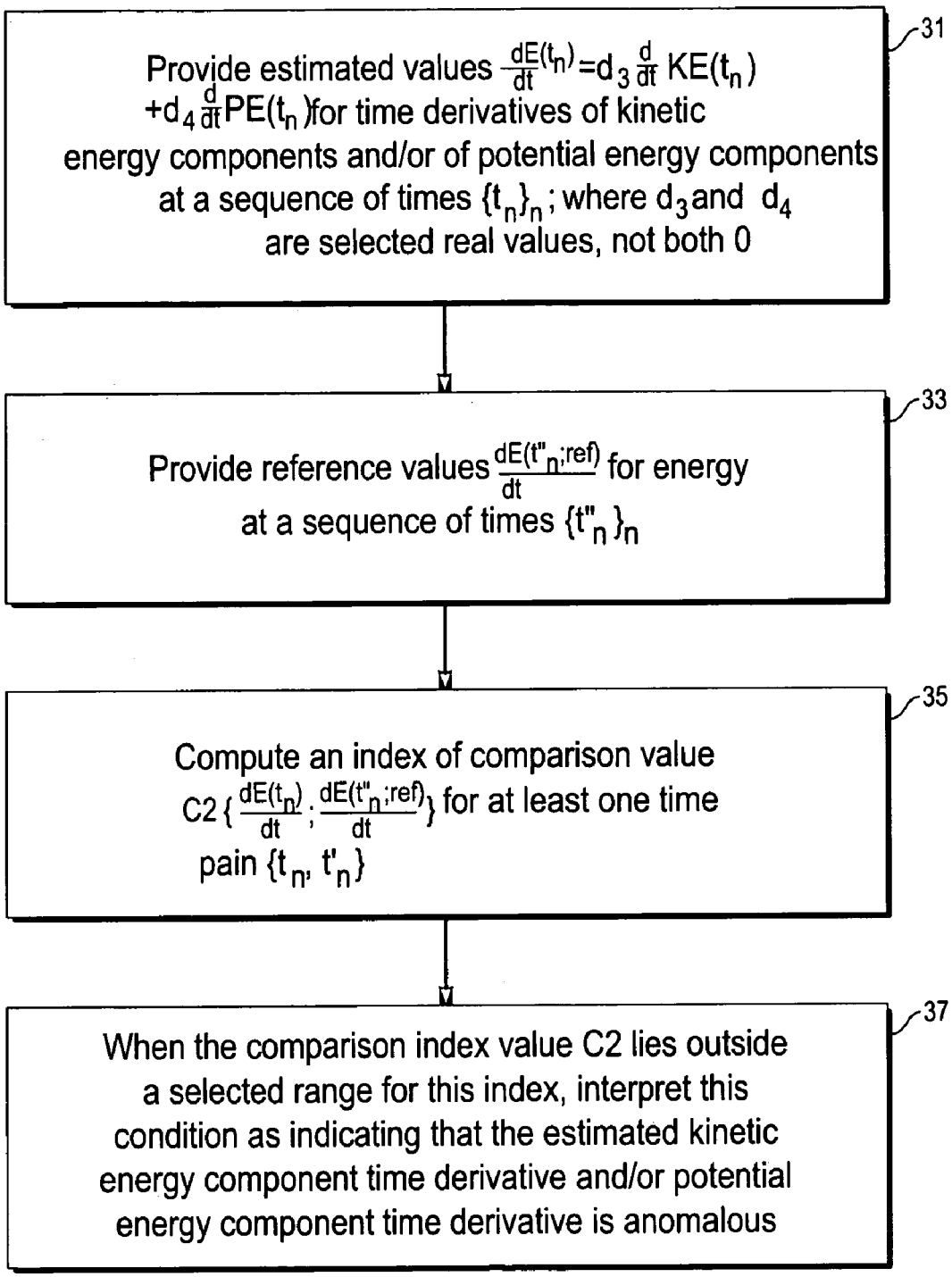

FIG. 3 is a flow chart of a procedure for practicing an embodiment using time derivatives of the energy component $E(t_n)$. In step 31, an aircraft system measures or estimates or otherwise provides an "estimated value", $(d/dt)E(t_n)=d3\cdot(d/dt)KE(t_n)+d4\cdot(d/dt)PE(t_n)$ of an energy component of an aircraft during an ascent phase or descent phase of a flight, at each of a first sequence of times (n=1, . . . , N1; $N1 \geqq 2$), where d3 and d4 are selected real values, not both 0. In step 33, the system provides or computes a reference value $(d/dt)E(t'_n;ref)$ of the energy component at a time, $t=t'_n$, determined with reference to the time $t_n$ (n=1, N1). The time sequence $\{t''_n\}$ may substantially coincide with the sequence $\{t_n\}$, or each time value $t''_n$ may be displaced by a calculable or measurable amount from the corresponding time value $t_n$. In step 35, the system computes an index of comparison value $C2\{(d/dt)E(t_n), (d/dt)E(t'_n;ref)\}$ of the estimated and reference energy component time derivatives for at least one time value pair $(t_n,t''_n)$. When the comparison index value C2 lies outside a selected range for this index, the system interprets this condition as indicating that the estimated energy component time derivative is anomalous or non-normal or may lead to an unstable aircraft maneuver (step 37).

The analysis may be further extended to consider a third comparison index, $C3\{E(t_n), E(t'_n;ref), (d/dt)E(t_n), (d/dt)E(t''_n;ref)\}$, that depends upon some or all of the estimated values and time rates of change of the estimated values of the energy components. Again, the comparison index C3 may use point values or a weighted average of the values E(t) and/or E(t;ref) and/or (d/dt)E(t)/dt and/or (d/dt)E(t;ref).

A formulation of, and use of, the equations of motion of an aircraft, including the effects of gravity, variable wind speeds, drag and lift forces on various control surfaces, variation of aircraft mass due to fuel consumption, and variable thrust, is set forth in an Appendix. A thrust vector is determined, as a function of the location coordinates, that will move the aircraft from an initial velocity vector $v_0(x_0, y_0,z_0)$ to a desired final velocity vector $v_f(x_f,y_f,z_f)$ as part of a takeoff phase or as part of an approach phase for a flight. The aircraft kinetic energy is a sum $$KE=m|v|^2/2+\omega\cdot I\cdot\omega/2, \tag{5}$$

where I(t) is an instantaneous moment of inertia tensor for the aircraft and ω(t) is an aircraft rotation vector, computed with reference to a center of gravity or other selected location determined with reference to the aircraft. The rotational component of kinetic energy may be negligible or may be ignored for other reasons. The aircraft potential energy may be taken to be m·g·h, as in Eq. (2), where h is the aircraft altitude above local ground level.

Appendix: A Formulation of Aircraft Equations of Motion

Let $v(x,y,z)=(v_x, v_y, v_z)$ by the vector velocity for an aircraft cg, let m=m(t) be the mass of the aircraft (with or without fuel consumption accounted for), and let $F(x,y,z)=(F_x, F_y, F_z)$ by the total force vector acting upon the aircraft, including a thrust vector. One vector equation of motion for the aircraft is $$d\{mv\}/dt=F. \tag{A-1}$$

The time variation of the aircraft mass is likely close to linear (m(t)≈m0−m1·t). When the aircraft thrust vector F(thrust) is known as a function of the location coordinates (x,y,z), Equation (A-1) can be re-expressed as $$\begin{aligned} d(mv)/dt &= m\{(\delta(mv)/\delta x)(dx/dt)+(\delta(mv)/\delta y)(dy/dt)+(\delta(mv)/\delta z)(dz/dt)\} \\ &= \{\delta(mv)/\delta x)v_x+\delta(mv)/\delta y)(v_y+\delta(mv)/\delta z)v_z\} \\ &= (v'\Delta)(mv)=F \end{aligned} \tag{A-2}$$

The force vector may be approximated as $$F(x,y,z)=-mgk+F(\text{drag/wind})+F(\text{liftt})+F(\text{thrust}) \tag{A-3}$$

where (i,j,k) is a Cartesian coordinate system unit vector triad, k has the direction of a local radial vector (planar Earth approximation for a relatively small region). and F(drag/wind) and F(lift) are a drag/wind force vector and a wind force vector acting on the aircraft and its control surfaces.

A component of drag/wind force is initially assumed to involve only the component of total velocity in that coordinate direction so that $$F(\text{drag/wind})=(\sigma_x(v_x+u_x)^2, \sigma_y(v_y+u_y)^2, \sigma^z(v_z+u_z)^2), \tag{A-4}$$

where $u=(u_x, u_y, u_z)$ is the local wind velocity vector, which may be constant or may depend upon one or more of the location coordinates (x,y,z). The drag coefficient vector $\sigma=(\sigma_x, \sigma_y, \sigma_z)$ will depend upon the angle of attack χ upon aileron surfaces orientation angle α, upon flap angle/extension β, upon rudder angle γ, upon elevator angle δ, and upon angular orientation angles (φ,θ) of the aircraft fuselage and empennage relative to the local Cartesian coordinate system. As a first approximation, the drag coefficient vector is expressed as a sum of terms $$\sigma=\sigma(\text{aileron})+\sigma(\text{flap})+\sigma(\text{rudder})+\sigma(\text{elevator})+\sigma(\text{fuselage})+\sigma(\text{empennage}), \tag{A-5}$$

where the individual vector contributions (e.g., σ(aileron)) are determined for the particular aircraft configuration and projected area of the relevant control surface, using empirical and/or experimental information. For example, if a particular aircraft control surface is planar and aircraft velocity is subsonic, a first approximation to the drag force coefficient for an airfoil surface can be expressed in terms of momentum transfer rate as $$\sigma(\Psi)=\sigma 1\sin^2\Psi, \tag{A-6}$$

where Ψ is an angle of the airfoil surface normal relative to a vector representing movement of air past the airfoil.

The lift component F(lift) depends upon total aircraft velocity, $(v+u)^2$, upon angle of attack χ of a wing or other contributing surface that contributes to lift, and upon local air density ρ, $$F(\text{lift})=F((v+u)^2, \chi,\rho) \tag{A-7}$$

preferably using Bernoulli's equation. Unlike the drag force, a movement of air in one direction may give rise to a lift force in a different (e.g., perpendicular) direction.

Incorporating these characterizations, the equations of motion of the aircraft in response to extraneous forces (wind, draft, lift, gravity, etc.) is re-expressed as $$(v\cdot\Delta)(mv)=i\{2\sigma_x(v_x+u_x)^2+2F_x(\text{lift})\}2F_x(\text{thrust})\}+j\{2\sigma_y(v_y+u_y)^2+2F_y(\text{lift})\}+2F_y(\text{thrust})\}+k\{-2\text{ mg}+2\sigma_z(v_z+u_z)^2+2F_z(\text{lift})\}+2F_z(\text{thrust})\}. \tag{A-8}$$

Beginning at an initial location, $(x_0,y_0,z_0)$, one goal is to bring the aircraft from an initial condition $v(x_0,y_0,z_0)$ to a desired final condition $V(x_f,y_f,z_f)$ as the aircraft enters an approach zone or leaves a takeoff zone, by prescribing a thrust vector F(thrust) that will move the aircraft from the initial velocity condition $v(x_0,y_0,z_0)$ to the final velocity condition $v(x_f,y_f,z_f)$ without violating limits on the aircraft variables. Other formulations of aircraft equations of motion can be provided that incorporate the effects of (1) variation of aircraft mass, (2) presence of (variable) wind velocity, (3) components of drag force induced on various control surfaces and (4) gravity, as well as other effects that have smaller influence on aircraft motion. However, these equations of motion appear to manifest the major features, including the effects of a programmed thrust vector to move the aircraft from an initial condition $v_0(x_0,y_0,z_0)$ to a desired final condition $v_f(x_f,y_f,z_f)$ as part of an ascent phase or descent phase of the flight.

As a first approach, parameters and associated forces (drag, lift, thrust, etc.) may be measured at a sequence of times for a moving aircraft, and Eq. (A-8) may be solved for a sequence of corresponding location coordinates (x,y,z) to determine or estimate an aircraft velocity vector v and altitude h to determine aircraft kinetic energy KE and/or potential energy PE for this particular flight movement. Here, the kinetic energy and/or potential energy of the aircraft are determined or estimated off-line, after this portion of the flight is completed.

As a second approach, a proposed aircraft maneuver to move from an initial velocity condition $v(x_0,y_0,z_0)$ and initial altitude to a final velocity condition $v(x_0,y_0,z_0)$ and final altitude can be posited and a thrust field F(thrust) can be determined that will accomplish this can be determined, through solution of Eq. (A-8), before or during execution of the aircraft maneuver (on-line).

What is claimed is:

1. A method of monitoring energy components of an aircraft in flight, the method comprising:

providing an estimate or measurement of a value (referred to as an "estimated value") of an energy component, $E(t_n)=d1\cdot KE(t_n)+d2\cdot PE(t_n)$, of a combination of a kinetic energy component $KE(t_n)$ and a potential energy component $PE(t_n)$ of an aircraft during an ascent phase of a flight, at each of a first sequence of times ($n=1, \ldots, N$; $N\geqq 2$), where d1 and d2 are selected real numbers, at least one being non-zero;

providing a reference value $E(t'_n;ref)$ of the energy $E(t_n)$ at a time, $t=t'_n$, determined with reference to the time $t_n$ ($n=1, \ldots, N$);

providing an index of comparison $C1\{E(t_n), E(t'_n;ref)\}$ of the estimated and reference energy components for at least one time numbered n; and when a value of the comparison index C1 lies outside a selected range, interpreting this condition as indicating that the estimated energy component is anomalous.

2. The method of claim 1, further comprising:

providing reference values, $KE(t'_n;ref)$ and $PE(t'_n;ref)$, of kinetic energy and potential energy components for said estimated values; and choosing said comparison index from the group of indices consisting of: (1) a first ratio $E(t_n)/E(t'_n;ref)\}$; (2) a second ratio $E(t'_n;ref)/E(t_n)$; (3) a difference $E(t_n)-E(t'_n;ref)\}$; (4) an absolute difference $|E(t_n)-E(t'_n;ref)|$; (5) a normalized difference $\{E(t_n)-E(t'_n;ref)\}/\{a\cdot E(t_n)+(1-a)\cdot E(t'_n;ref)\}$, where a is a selected value in a range $0\leqq a\leqq 1$; and (6) weighted averages, $|KE(t^n)-KE(t'_n;ref)|^p$ and $|PE(t_n)-PE(t'_n;ref)|^p$, of differences of kinetic energy terms and of potential energy terms, where p is a selected positive number.

3. The method of claim 1, further comprising choosing said comparison index to include at least one of said values $E(t_n)$ for said estimated energy component and at least one of said values $E(t_n;ref)$ for said reference energy component.

4. The method of claim 1, further comprising choosing said comparison index to include at least one weighted average of said values $E(t_n)$ for said estimated energy component and at least one weighted average of said values $E(t_n;ref)$ for said reference energy component, over said respective sequences of times $\{t_n\}$ and $\{t'_n\}$.

5. The method of claim 1, further comprising:

providing an estimated value $(d/dt)E(t_n)=d3\cdot(d/dt)KE(t_n)+d4\cdot(d/dt)PE(t_n)$ of a time rate of change of said estimated energy component, where d3 and d4 are selected real values, not both 0; and providing a reference value $(d/dt)E(t''_n;ref)$ of a time rate of change of said reference energy component, where $t''_n$ is a time determined with reference to said time $t_n$.

6. The method of claim 5, further comprising:

providing an index of comparison $C2\{(d/dt)E(t_n); (d/dt)E(t''_n;ref)\}$ of said time rates of change of said estimated energy component and said reference energy component for at least one time numbered n".

7. The method of claim 6, further comprising choosing said comparison index to include at least one of said values $(d/dt)E(t_n)$ for said estimated energy component and at least one of said values $(d/dt)E(t''_n;ref)$ for said reference energy component.

8. The method of claim 6, further comprising choosing said comparison index to include at least one weighted average of said values $(d/dt)E(t_n)$ for said estimated energy component and at least one weighted average of said values $(d/dt)E(t''_n;ref)$ for said reference energy component, over said respective sequences of times $\{t_{n'}\}$ and $\{t''_{n'}\}$.

9. The method of claim 6, further comprising:

when a value of said comparison index C2 lies outside a selected range, interpreting this condition as indicating that said time rate of change of said estimated energy component is anomalous.

10. The method of claim 5, further comprising:

providing an index of comparison $C3\{E(t_{n'}), E(t_{n'};ref); (d/dt)E(t_n), (d/dt)E(t''_n;ref)\}$ of said estimated values and time rates of change of said estimated energy component and said reference energy component for at least one time numbered n'; and when a value of the comparison index C3 lies outside a selected range, interpreting this condition as indicating that at least one of said value and said time rate of change of said estimated kinetic energy component is anomalous.

11. The method of claim 1, further comprising choosing said real numbers d1 and d2 to be one of the following pairs of real numbers: (d1,d2)=(1,0), (d1,d2)=(1,1), (d1,d2)=(0,1), and (d1,d2)=(d,1−d) with $0<d<1$.

12. The method of claim 1, further comprising determining said energy component by a process comprising:

measuring aircraft thrust vector components and at least one of extraneous force vector components, comprising wind vector components, drag force vector components, lift force vector components and gravity force components, at said sequence of times $\{t_n\}$;

determining or estimating at least one of velocity vector v of said aircraft and altitude of said aircraft at location coordinates $(x_n,y_n,z_n)$ corresponding to said time $t_n$, from a solution of an equation $(v\cdot\Delta)(mv)$=a sum of extraneous vector forces F(extraneous)acting on said aircraft+a thrust vector force F(thrust) provided by one or more engines of said aircraft;

determining or estimating at least one of an aircraft velocity vector $v(x_n,y_n,z_n)$ and an aircraft altitude for at least one of said times $t_n$; and computing said estimated or measured value of said energy component $E(t_n)$ for at least one of said times $t_n$, using the determined or estimated aircraft velocity vector and aircraft altitude.

13. The method of claim 1, further comprising determining said energy component by a process comprising:

providing at least one of extraneous force vector components F(extraneous), comprising wind vector components, drag force vector components, lift force vector components and gravity force components, at said sequence of times $\{t_n\}$;

providing an estimate of thrust vector components F(thrust) required to transport an aircraft from a selected initial velocity condition $v(x_0,y_0,z_0)$ to a selected final velocity condition $v(x_f,y_f,z_f)$ under influence of the at least one extraneous force components;

determining or estimating at least one of velocity vector v of said aircraft and altitude of said aircraft at location coordinates $(x_n,y_n,z_n)$ corresponding to said time $t_n$, from a solution of an equation $(v\cdot\Delta)(mv)$=a sum of extraneous vector forces F(extraneous)acting on said aircraft+the thrust vector force F(thrust), at said sequence of times $\{t_n\}$;

determining or estimating at least one of an aircraft velocity vector $v(x_n,y_n,z_n)$ and an aircraft altitude for at least one of said times $t_n$; and computing said estimated or measured value of said energy component $E(t_n)$ for at least one of said times $t_n$, using the determined or estimated aircraft velocity vector and aircraft altitude.

14. A method of monitoring energy components of an aircraft in flight, the method comprising:

providing an estimate or measurement of a value (referred to as an "estimated value") of an energy component, $(d/dt)E(t_n)=d3\cdot(d/dt)KE(t_n)+d4\cdot(d/dt)PE(t_n)$, of a combination of time derivatives of a kinetic energy component $KE(t_n)$ and a potential energy component $PE(t_n)$ of an aircraft during an ascent phase of a flight, at each of a first sequence of times (n=1, . . . , N; N≧2), where d3 and d4 are selected real numbers, at least one being non-zero;

providing a reference value $(d/dt)E(t''_n;ref)$ of the energy component time derivative $(d/dt)E(t_n)$ at a time, $t=t''_n$, determined with reference to the time $t_n$ (n=1, . . . , N);

providing an index of comparison $C2\{(d/dt)E(t_n), (d/dt)E(t''_n;ref)\}$ of the estimated and reference energy component time derivatives for at least one time numbered n; and when a value of the comparison index C2 lies outside a selected range, interpreting this condition as indicating that the estimated energy component is anomalous.

15. The method of claim 14, further comprising:

providing reference values, $(d/dt)KE(t'_n;ref)$ and $(d/dt)PE(t'_n;ref)$, of kinetic energy and potential energy component time derivatives for said estimated values; and choosing said comparison index from the group of indices consisting of: (1) a first ratio $(d/dt)E(t_n)/(d/dt)E(t''_n;ref)\}$; (2) a second ratio $d/dt)E(t''_n;ref)/(d/dt)E(t_n)$; (3) a difference $d/dt)E(t_n)-(d/dt)E(t''_n;ref)$; (4) an absolute difference $|d/dt)E(t_n)-(d/dt)E(t''_n;ref)|$; (5) a normalized difference $\{d/dt)E(t_n)-(d/dt)E(t''_n;ref)\}/\{a\cdot.d/dt)E(t_n)+(1-a)\cdot(d/dt)E(t''_n;ref)\}$, where a is a selected value in a range 0≦a≦1; and (6) weighted averages, $|(d/dt)KE(t_n)-(d/dt)KE(t''_n;ref)|^p$ and $|(d/dt)PE(t_n)-(d/dt)PE(t''_n;ref)|^p$, of differences of kinetic energy terms and of potential energy terms, where p is a selected positive number.

16. The method of claim 14, further comprising choosing said comparison index to include at least one weighted average of said values $(d/dt)E(t_n)$ for said estimated energy component and at least one weighted average of said values $(d/dt)E(t''_n;ref)$ for said reference energy component, over said respective sequences of times $\{t_n\}$ and $\{t'_n\}$.

17. The method of claim 14, further comprising choosing said real numbers d1 and d2 to be one of the following pairs of real numbers: (d3,d4)=(1,0), (d3,d4)=(1,1), (d3,d4)=(0,1), and (d3,d4)=(d,1−d) with 0<d<1.

18. The method of claim 14, further comprising determining said energy component by a process comprising:

measuring aircraft thrust vector components and at least one of extraneous force vector components, comprising wind vector components, drag force vector components, lift force vector components and gravity force components, at said sequence of times $\{t_n\}$;

determining or estimating at least one of velocity vector v of said aircraft and altitude of said aircraft at location coordinates $(x_n,y_n,z_n)$ corresponding to said time $t_n$, from a solution of an equation $(v\cdot\Delta)(mv)$=a sum of extraneous vector forces F(extraneous)acting on said aircraft+a thrust vector force F(thrust) provided by one or more engines of said aircraft;

determining or estimating at least one of an aircraft velocity vector $v(x_n,y_n,z_n)$ and an aircraft altitude for at least one of said times $t_n$; and computing said estimated or measured value of said energy component $(d/dt)E(t_n)$ for at least one of said times $t_n$, using the determined or estimated aircraft velocity vector and aircraft altitude.

19. The method of claim 14, further comprising determining said energy component by a process comprising:

providing at least one of extraneous force vector components F(extraneous), comprising wind vector components, drag force vector components, lift force vector components and gravity force components, at said sequence of times $\{t_n\}$;

providing an estimate of thrust vector components F(thrust) required to transport an aircraft from a selected initial velocity condition $v(x_0,y_0,z_0)$ to a selected final velocity condition $V(x_f,y_f,z_f)$ under influence of the at least one extraneous force components;

determining or estimating at least one of velocity vector v of said aircraft and altitude of said aircraft at location coordinates $(x_n,y_n,z_n)$ corresponding to said time $t_n$, from a solution of an equation $(v\cdot\Delta)(mv)$=a sum of extraneous vector forces F(extraneous)acting on said aircraft+the thrust vector force F(thrust), at said sequence of times $\{t_n\}$;

determining or estimating at least one of an aircraft velocity vector $v(x_n,y_n,z_n)$ and an aircraft altitude for at least one of said times $t_n$; and computing said estimated or measured value of said energy component $(d/dt)E(t_n)$ for at least one of said times $t_n$, using the determined or estimated aircraft velocity vector and aircraft altitude.

* * * * *